United States Patent [19]

Marulic et al.

[11] 4,198,785

[45] Apr. 22, 1980

[54] MOVABLE THRESHOLD DOOR SEAL

[75] Inventors: Walter J. Marulic, Gary; Jack E. Gutridge, Dyer, both of Ind.

[73] Assignee: Pullman Incorporated, Chicago, Ill.

[21] Appl. No.: 949,821

[22] Filed: Oct. 10, 1978

[51] Int. Cl.[2] ..... E06B 7/20

[52] U.S. Cl. ..... 49/304; 49/425; 49/372

[58] Field of Search ..... 49/303, 304, 305, 425, 49/412, 372, 377; 160/40

[56] References Cited

U.S. PATENT DOCUMENTS

| | | | |
|---|---|---|---|
| 1,780,797 | 11/1930 | Roberts et al. | 49/303 X |
| 2,274,730 | 3/1942 | Owen | 49/425 |
| 2,488,063 | 11/1949 | Massie | 49/372 X |
| 2,899,238 | 8/1959 | Swanson | 49/377 X |
| 3,628,588 | 12/1971 | Dixon | 160/40 |

*Primary Examiner*—Kenneth Downey
*Attorney, Agent, or Firm*—Stephen D. Geimer

[57] ABSTRACT

A door seal for an inside compartment of a railway passenger vehicle. A door that moves on rollers laterally into and from a door opening to a stored position in a hollow portion of an adjacent wall. The lower portion of the door is located adjacent a threshold having a movable, flexible seal that moves between a flat position covering a roller track portion of the threshold to a substantially upright position against the bottom of the door when the door is located in a closed position. The seal is constructed of a resilient material and bends to be urged against the lower portion of the door in such a fashion as to seal out noise, debris, light and the like. When the door is open the seal returns to a flat, horizontal position to prevent an accumulation of debris or dirt in the door track which would interfere with movement of the door.

4 Claims, 5 Drawing Figures

10
12
14
16
18
20
22
23
24
25
28
30
31
32
34
36
38
40
42
44
46
48
50
52
54
56
58
60
61
62
63
64
66
68
70
72
75
2
3
5

MOVABLE THRESHOLD DOOR SEAL

BACKGROUND OF THE INVENTION (1) Field Of The Invention:

This invention pertains to railway passenger vehicles and in particular to sliding doors which are used to open and close off compartments, washrooms and the like. Specifically, the disclosure is directed to a threshold which includes a seal that moves between a flat position to provide a smooth surface at the door opening to an upright position in contact with the lower portion of the door in a sealing position.

(2) Description Of The Prior Art:

While the prior art has recognized the problems involved in guiding the lower portion of a sliding door and the additional problem of keeping clean any track or depression in the threshold used to guide the lower portion of the door, several attempts have been made and which are improved upon by the present disclosure. Specifically, the Stermac U.S. Pat. No. 3,745,706 (1973) and the Gatton et al., U.S. Pat. No. 3,584,417 (1971), show configurations used to both guide and seal the lower portion of the sliding door. While these patents have attempted to solve guiding and sealing problems with the structure that both guides and seals simultaneously, such structures have not met with widespread acceptance because of close dimensional requirements which must be held to insure the required sealing without interfering with smooth movement of the door.

The present disclosure shows a configuration for not only guiding but providing a sealing member which serves a dual purpose function to keep the guide track free from obstructions and debris and to move from a horizontal to a generally upright position to seal off the bottom of the door when it is in a closed position.

SUMMARY OF THE INVENTION

This disclosure relates to a sliding door for use in a railway passenger compartment, washroom or the like. As is known, sliding doors are a preferable mode of opening and closing confined areas because they generally require less space in a space limited environment. Problems encountered with sliding doors have generally centered about the manner of supporting the door for rolling movement between an open position in the door opening and a closed position stored in a hollow portion of the adjacent wall. Specifically, the door is supported on rollers, a threshold or track is provided in which the rollers are guided during movement. In the event dirt or the accumulation of debris or other material in the track occurs, movement of the door is inhibited. It is necessary that the guide track be kept free of debris in order that the rollers may move smoothly therein. Consequently, it is desirable to provide a seal that not only closes off the guide track to keep out debris but also seals the bottom portion of the door when it is closed to maintain privacy within the compartment.

It is thus an object of this invention to provide a sliding door having a leading edge which engages and lifts a flexible door seal from a guide track and positions the seal adjacent the lower portion of the door when the door is closed. It is another object to provide the seal with a flexible material which returns the seal into a covering position above the door track when the door is open.

It is another object of the disclosure to provide a sliding door for railway vehicles wherein the top part of the door is guided by channels extending alongside thereof and the bottom portion of the door is guided by rollers positioned in a track of a door threshold having a flexible seal.

Another object of this invention is to provide a sliding door having a so-called trailing edge which is sealed by flexible members to insure that noise and air can not enter past the vertical edges of the door when it is closed.

It is another object of this disclosure to provide a flexible seal having a free end and a hinged end. The seal also extends across a door support track to keep the track free of debris. It is also an object to have the seal with a reduced or neck portion allowing the seal to bend in a cantilever fashion as the door is closed.

These and objects of the invention will become apparent to those having ordinary skill in the art with reference to the following description, drawings and appended claims.

DETAILED DESCRIPTION

Figures 1, 2, 3, 4, 5:
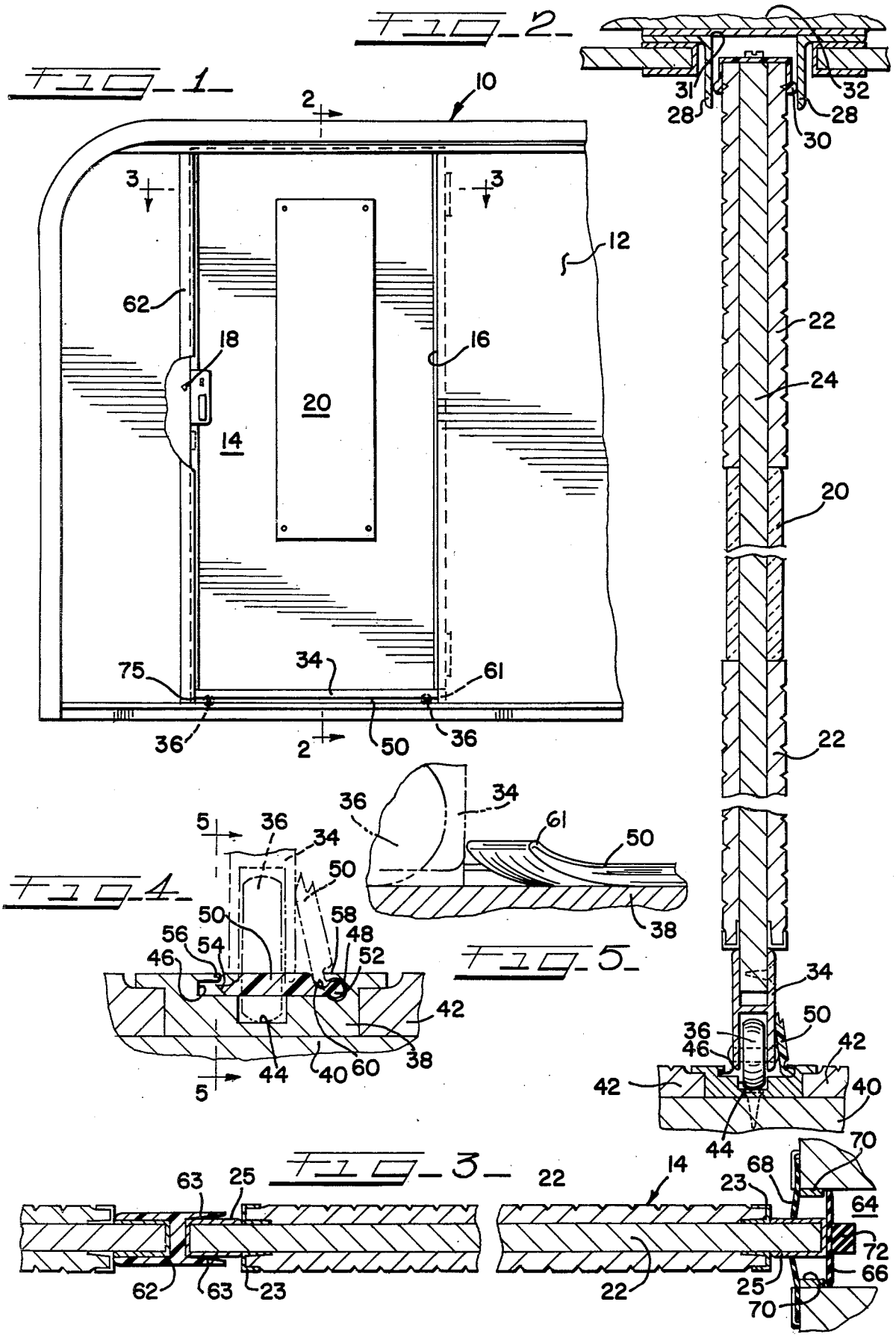
FIG. 1 is a plan view of a portion of a railway vehicle showing a sliding door of this disclosure.
FIG. 2 is a sectional view taken generally along lines 2—2 of FIG. 1.
FIG. 3 is another sectional view taken generally along the lines 3—3 of FIG. 1; and, FIG. 4 is an enlarged sectional view of the threshold and seal in both the horizontal and substantially upright, sealing position.
FIG. 5 is a sectional view taken generally along lines 5—5 of FIG. 4.

Referring now to the drawings and in particular to FIG. 1, a portion of a railroad passenger car is designated by the numeral 10. The portion shown in the entryway and door to a compartment or sleeper 12. As shown, the compartment 12 may be closed off with a sliding door designated 14. Door 14 is positioned within a door frame 16. A conventional door lock 18 is attached to the leading edge of the door for securely locking the door in place. As shown in FIG. 1, the door may include a mirror 20.

The door 14 is shown with an outer cover 22 which may be an attractive carpeting or other material that will provide a functional sound-absorbing feature as well as be aesthetically pleasing. The outer cover 22 is held in place by trim or rails 23 which extend along each edge. The center of the door is a core 25 which is a solid member to provide rigidity and strength to the door 14. As shown in FIG. 3, both vertical edges of the door have edge trim 25 attached thereto.

Door frame 16 comprises a top door guide 28 which may be an angular member positioned on each side of the door to guide the door during movement. Seal 30 is positioned at the top portion of the door and has protrusions extending adjacent to door guides 28. As shown in FIG. 2, door guides 28 may be attached to a mounting plate 31 for attachment to the car ceiling 32.

The door includes a support channel 34 which is attached to the bottom portion and includes a pair of legs extending downwardly to provide a housing for a pair of rollers 36. Rollers 36 move within a threshold 38 which includes a cut-out portion or track 44. As shown in FIG. 2 and 4, the threshold 38 is securely attached to the floor 40 and has carpeting 42 or other suitable floor covering adjacent on each side.

A recessed track 44 is located at the central bottom portion of the threshold 38. A pair of side recesses 46, 48 are located within the threshold. Recess 48 receives the seal 50. Recess 46 is located across from recess 48 and the tab 56 overlaps the end portion 54 of the seal 50. The seal 50 includes a longitudinally extending connecting portion 52 which is supported within the groove or recess 48. The end portion 54 as best shown in FIG. 4 is undercut along the entire length of the seal 50, and underlies the tab 56 to flexibly secure the seal in its covering position. Since the seal is flexible it will, however, become disengaged from the tab as it is peeled or moved upwardly as will be described.

As shown in FIG. 4, the seal 50 includes a cut-out or neck portion 60 which is a reduced cross-sectional area. This reduced area allows the seal 50 to pivot and bend along its entire extent in a cantilever fashion as it is pushed upwardly by the door moving across the door opening. As the seal 50 is pushed upwardly it is resiliently resisted by the biasing tab 58 which urges the seal to its covering position. As shown in FIG. 5, the extreme right end of the seal includes a crimped portion 61 which projects upwardly or vertically from the threshold 38, whereas the rest of the seal lies flat covering the track 44 as shown in FIG. 4 is attached in a vertical position. Thus, even when the door is fully open, crimped end portion 61 will always be upright or project vertically and provide a so-called leading edge. Consequently, when the door is closed the leading edge is already upright and will allow the door seal 50 to be peeled from the threshold 38.

As shown in FIG. 3, the door framing 16 includes an upright extruded plastic piece or molding 62 which has jaws 63 adapted to form an opening to receive the door when it is closed to thus keep out light and air.

The so-called trailing edge of the door which remains within the door recess or receptacle 64 includes a stop seal 66 that operates in conjunction with flap seals 68 to seal the trailing edge of the door when the door is open. The seal 66 engages stop 70. Bumper 72 absorbs shock encountered when the door is fully opened and contacts an inner part of the compartment wall (not shown).

In operation it is shown that as the door moves from a fully open position where it is stored within the hollow portion 14 of the wall 12, the so-called lower, leading edge 75 of the door 14 will be in contact with an end portion of the door seal designated 61 in FIG. 1. Thus, this portion 61 is always in an upright position and in contact with the door. This positioning allows the seal to then be peeled from the threshold 38 as the door moves into the door opening. Because of the cantilever design of the seal 50 the seal is allowed to flex about the tin or neck portion 60. Thus, by permitting the seal to move in a cantilever fashion a spring force is obtained which insures sealing contact between the seal 50 and the lower support channel 34. However, this force is not of such a great magnitude as to interfere with free movement of the door during opening and closing. Also, a finger or cam could be provided to assist in lifting or peeling the threshold seal 50 from its horizontal position covering the roller rail 44.

Thus, it is seen that with the door seal arrangement provided herein a novel way of both sealing the bottom of a door when it is closed and keeping debris out of the door support track when it is open has been provided.

The foregoing description and drawings merely explain and illustrate the invention and the invention is not limited thereto, except insofar as the appended claims are so limited, as those who are skilled in the art and have the disclosure before them will be able to make modifications and variations therein without departing from the scope of the invention.

What is claimed is:

1. A door for a railway vehicle, the improvement comprising;

a door, a frame surrounding said door, said frame having spaced sides providing an opening for movement of the door between an open and closed position, roller means for supporting said door and for guiding the door for movement into and from the door opening;

threshold means at the bottom of said door opening, said threshold means having recessed track means to receive and guide the bottom portion of the door during movement, seal means includes a flexible member having a longitudinally extending connecting portion on one side thereof, means connecting said connecting portion of the seal to said threshold means whereby said seal member is movable from a first position covering said track to a second position wherein said seal member is raised vertically from said covering position and is in resilient biasing engagement with one side of said door, said flexible seal member having an end portion thereof raised vertically from said threshold, and means on said door, initially on movement of the same, engaging said end portion of said seal to raise the same and whereby the same is moved to its second position.

2. The invention in accordance with claim 1, said door including rollers with means attaching said rollers at the bottom portion of said door;

said threshold means having track means adapted to receive said rollers and guide same during movement of the rollers into and from the door opening;

said door frame including upstanding framing members;

a hollow portion located adjacent the upstanding frame members and providing a housing to receive the door when it is in the door open position;

second flexible seal means adjacent said framing members and extending into contact with the door for sealing and holding the door in the open and closed position; and stop means on said door and cooperative with associated members adjacent said framing means for restricting movement of the door from the receptacle and holding the door in a door closed position.

3. The invention in accordance with claim 1 wherein said seal includes a longitudinally extending narrow neck portion opposite to said connecting portion, and said threshold means including biasing tab means adapted to engage the narrow portion of the seal as the seal moves from a flat to an upright position thereby providing a cantilever and spring biasing force at the seal as it bears upon the lower portion at the door.

4. The invention in accordance with claim 1, said seal having a second side opposite to said connecting portion extending longitudinally, said second side including an undercut notch in the upper surface terminating in a projecting portion, a tab on said threshold means disposed in overlapping relation over said projecting portion thereby maintaining the said seal in said covering portion, said projecting portion being flexible to permit vertical movement around said tab when said seal is raised to said covering position.

* * * * *